US006095511A

United States Patent [19]

Jäger

[11] Patent Number: 6,095,511

[45] Date of Patent: Aug. 1, 2000

[54] PROCESSING CHANNEL FOR INCOMING IMBRICATED PRINTED PRODUCTS

[75] Inventor: Erich Jäger, Frauenfeld, Switzerland

[73] Assignee: Ferag AG, Hinwil, Switzerland

[21] Appl. No.: 09/120,932

[22] Filed: Jul. 22, 1998

[30] Foreign Application Priority Data

Jul. 22, 1997 [CH] Switzerland ..... 1778/97

[51] Int. Cl.[7] ..... B42B 2/00

[52] U.S. Cl. ..... 270/52.29; 270/52.16; 270/52.14; 270/58.29

[58] Field of Search ..... 270/52.14, 52.16, 270/52.22, 52.26, 52.29, 58.26, 58.29; 271/225

[56] References Cited

U.S. PATENT DOCUMENTS

| | | | |
|---|---|---|---|
| 336,878 | 2/1886 | Wood | 270/52.16 |
| 1,586,196 | 5/1926 | Halvorsen . | |
| 1,659,099 | 2/1928 | Halvorsen . | |
| 2,873,113 | 2/1959 | McWhorter | 270/52.29 X |
| 3,054,612 | 9/1962 | Godlewski | 270/58.29 |
| 3,362,304 | 1/1968 | Skolnick | 270/52.29 X |
| 5,005,815 | 4/1991 | Auksi | 270/52.29 X |
| 5,165,672 | 11/1992 | Backman | 270/52.22 |

FOREIGN PATENT DOCUMENTS

| | | |
|---|---|---|
| 1 171 444 | 6/1964 | Germany . |
| 1 922 257 | 11/1970 | Germany . |
| 31 35 930 | 6/1982 | Germany . |
| 42 35 452 | 4/1994 | Germany . |
| WO 98/03419 | 1/1998 | WIPO . |
| WO 98/35901 | 8/1998 | WIPO . |
| WO 98/37003 | 8/1998 | WIPO . |

*Primary Examiner*—Christopher P. Ellis
*Assistant Examiner*—Patrick Mackey
*Attorney, Agent, or Firm*—Alston & Bird LLP

[57] ABSTRACT

An apparatus for processing printed products which has a stationary processing channel (14), and a feeding arrangement (28) for introducing printed products (12) into the processing channel in an imbricated formation. A conveying arrangement (26) transports the printed products which are introduced into the processing channel (14) longitudinally along the channel. The feeding arrangement (28) has a conveying member (38), which is driven in the feeding direction (Z), and a pressure-exerting element (42), which forms a conveying nip (40) with the conveying member. The conveying nip (40) terminates at a distance (E) above the base (16) which is somewhat greater than the dimension (G) of the printed products (12), measured at right angles to the leading edge (12') of the latter. The conveying arrangement (26) has conveying elements (24") with a deflecting surface (30) for the printed products (12) which are still retained in the conveying nip (40). These measures ensure that the printed products are introduced into the processing channel, and then conveyed further, in a reliable and controlled manner.

14 Claims, 4 Drawing Sheets

PROCESSING CHANNEL FOR INCOMING IMBRICATED PRINTED PRODUCTS

BACKGROUND OF THE INVENTION

The present invention relates to an apparatus for processing printed products.

An apparatus of this type is disclosed in DE-A-42 35 452. For the purpose of transporting the products which are introduced into a processing channel, the apparatus has a conveying arrangement designed as a suction-belt conveyor. The suction openings of the suction belt are arranged in relation to the suction openings of the suction box such that, in the manner of a slide control means, the active suction region can run along with the product which is respectively deflected in the conveying direction. As a result, the suction region does not act on the introduced product until the latter has run up against a stop arranged at the suction-belt conveyor, whereupon the product is gripped by the suction-belt conveyor, by virtue of the suction action, and is transported further in the conveying direction.

The earlier CH Patent Applications Nos. 1997 0325/97 and 1997 0366/97 and the corresponding international Patent Applications PCT/CH98/00015 and PCT/CH98/00016 disclose other apparatuses which are intended for processing printed products and have a stationary processing channel, which is bounded by a side wall and a base, a feeding arrangement for introducing printed products into the processing channel with an edge in front, and a conveying arrangement for transporting, in the longitudinal direction of the processing channel, the printed products which are introduced into the processing channel and have their edge butting against the base and a flat side butting against the side wall. The feeding arrangements mentioned in these documents are transporters, feeders, feeding stations or other known feeding means. These introduce the printed products into the processing channel individually and at high speed. The high feeding speed means that there is a risk that the printed products may be damaged. Considerable forces act on the printed products when the latter strike against the base of the processing channel, which can result in the printed products springing back and thus in problems regarding deflection in the conveying direction. An object of the present invention is to develop an apparatus of the above mentioned type such that, along with careful handling of the printed products, it is ensured that these printed products are reliably carried along in the longitudinal direction of the processing channel.

SUMMARY OF THE INVENTION

According to the invention, the printed products are introduced into the processing channel in an imbricated formation, i.e. such that they overlap one another in the feeding direction. This permits a low feeding speed and, as a result of the small forces acting on the printed products, ensures careful handling of the printed products. Since, according to the invention, the printed products are retained in the conveying nip until just before they reach the base of the processing channel, they are prevented from being carried along undesirably in the longitudinal direction of the processing channel, and are conveyed at a precisely defined speed, namely that of the conveying member, until they are in the vicinity of the base. The inventive, controlled introduction of the printed products into the processing channel prevents the printed products from dropping through a considerable height, if introduction takes place from top to bottom, and ensures that the printed products are introduced well into the processing channel, even if the introduction takes place more or less in the horizontal direction. Furthermore, the situation where the conveying arrangement and the printed products which are being fed have an adverse effect on one another is avoided in that these printed products are prevented from being carried along since they are laterally deflected out of the region of movement of the conveying elements of the conveying arrangement.

A particularly preferred embodiment of the inventive apparatus provides for the lateral deflection of the leading edges of the printed products as they enter the processing channel by means of a deflecting surface on the upper side of each of the conveying elements. This avoids damage to the printed products as they are introduced into the processing channel, in a straightforward manner, by the conveying elements which, as seen in the longitudinal direction of the processing channel, are located in the region of the feeding arrangement.

The processing channel includes a first side wall and a base, and preferably also a second side wall which is laterally spaced from the first side wall and the conveying elements, so as to define a free space for accommodating the printed products as they are advanced into the processing channel. This configuration increases reliability as the printed products are introduced into the processing channel.

The feeding arrangement for introducing the printed products into the processing channel is preferably mounted so as to permit adjustment of the distance above the base at which the products are released. This permits reliable processing of printed products of different formats.

A particularly space-saving embodiment of the inventive apparatus provides for the introduction of the printed products into the processing channel along a direction substantially perpendicular to the longitudinal direction of the processing channel. Alternatively, the direction of introduction may be inclined with respect to the longitudinal direction of the processing channel, which ensures particularly careful handling of the printed products. Since these printed products are also moved in the conveying direction even as they are being introduced, the forces during deflection are particularly low.

The feeding arrangement for introducing the printed products into the processing channel defines a conveying nip having a discharge end which is laterally spaced from the first side wall of the processing channel a distance at least equal to the thickness of the printed products. This prevents, in a straightforward manner, successive printed products from obstructing one another.

In a preferred embodiment, the feeding arrangement comprises a conveying member which is driven in the feeding direction, and a pressure exerting member, which forms the conveying nip. Also, the conveying member comprises an endless conveying belt which is entrained about a plurality of rollers so as to define an active run which is substantially parallel to the first side wall. This makes it possible for the printed products to be introduced in any desired formation.

The pressure exerting member, as measured in the feeding direction, is shorter than the conveying member, and is preferably formed by a ball or roller path. Also, the conveying member projects beyond the pressure-exerting element and, on the inlet side of the conveying nip, thus forms a defined rest for the printed products which are to be introduced.

A product transporting arrangement may be provided upstream of the feeding arrangement, so as to discharge the printed products to the feeding arrangement in a manner synchronized with the conveying arrangement which conveys the products longitudinally along the processing channel. The feeding arrangement thus may be of particularly straightforward design since synchronization with the conveying arrangement takes place not by way of the feeding arrangement but during the transfer of the printed products from the transporting arrangement to the feeding arrangement.

By designing the conveying arrangement so as to comprise two conveyor segments, which are arranged one behind the other in the conveying or longitudinal direction, the acceleration forces acting on the printed products in the conveying direction can be kept particularly small.

BRIEF DESCRIPTION OF THE DRAWINGS

The invention will now be explained in more detail with reference to the exemplary embodiments illustrated in the drawings, in which, purely schematically.

DETAILED DESCRIPTION OF THE PREFERRED EMBODIMENTS

Figure 1:
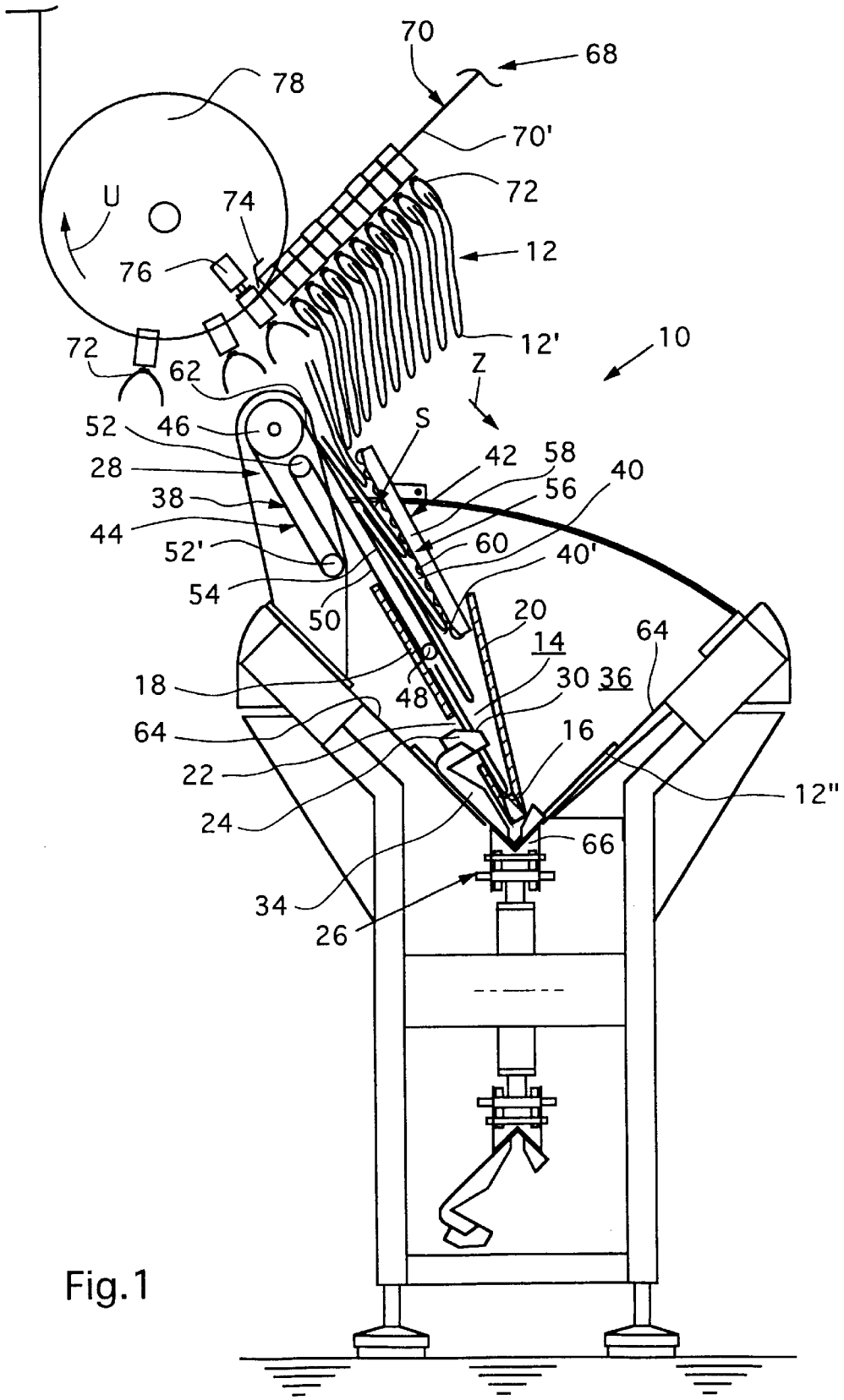
FIG. 1 shows, in a vertical section, an inventive apparatus which has the printed products which are to be processed fed to it by means of a transporting arrangement.

The apparatus 10 which is shown in FIG. 1 and is intended for processing printed products 12, such as newspapers, periodicals and parts thereof, has a stationary processing channel 14 which is open towards the top. As can also be seen from FIGS. 2 and 3, the processing channel is bounded by two side walls 18, 20, which are arranged at an acute angle with respect to one another, and, at the bottom by a base 16, which connects the side walls to one another, it being the case that, in relation to the vertical, the two side walls are inclined to the same side, but the first side wall 18 is inclined to a greater extent than the second side wall 20. The longitudinal direction of the processing channel 14 runs at right angles to the plane of the drawing.

Figure 2:
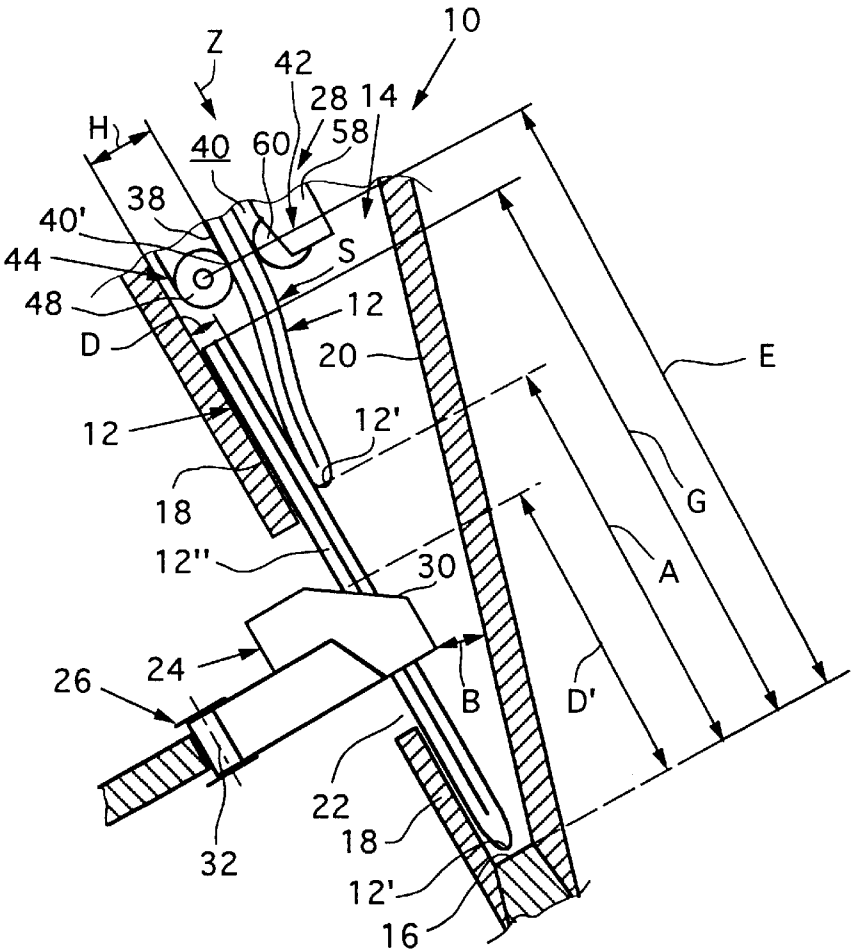
FIG. 2 shows part of the apparatus which is shown in FIG. 1, but on an enlarged scale, at a specific point in time during the processing of printed products.

The first side wall 18 has a through-passage 22 which runs in the longitudinal direction and through which pushing lugs 24, which form conveying elements 24", engage in the processing channel 14. The pushing lugs 24 form parts of a conveying arrangement 26 and are intended for transporting, in the longitudinal direction of the processing channel 14, printed products 12 which are introduced into the processing channel 14 by means of a feeding arrangement 28. Between the pushing lugs 24 and the second side wall 20, there is a free space, the width B of which is greater than the thickness D of the printed products 12 which are to be processed (FIG. 2). On the side which is directed away from the base 16 and towards the feeding arrangement 28, the pushing lugs 24 have a deflecting surface 30, which encloses an obtuse angle together with the imaginary extension of the first side wall 18 through the through-passage 22.

Figure 3:
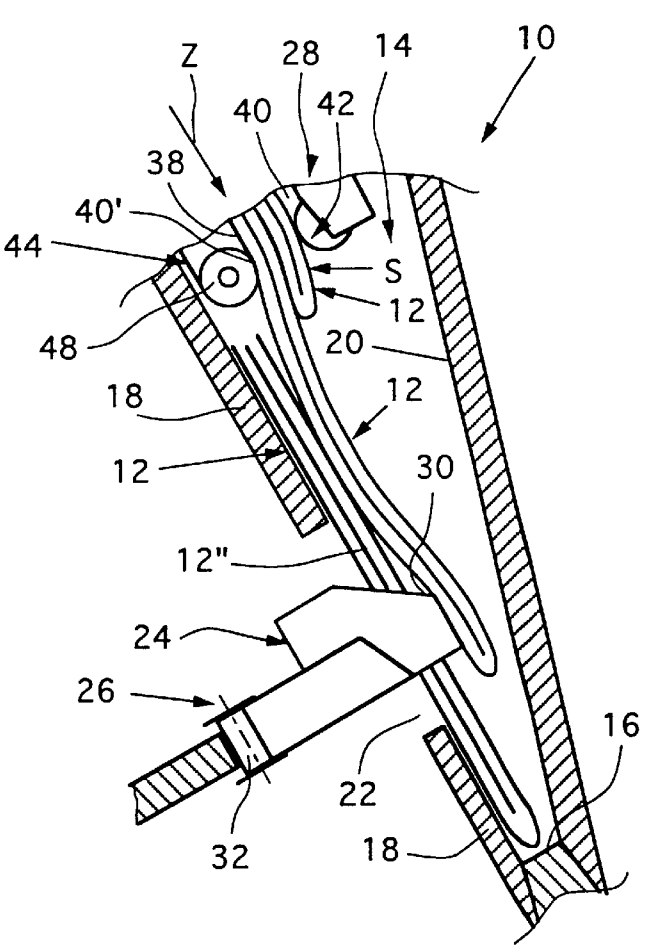
FIG. 3 shows, in the same illustration as in FIG. 2, the same part of the apparatus at a later point in time during the processing of printed products.
Figure 4:
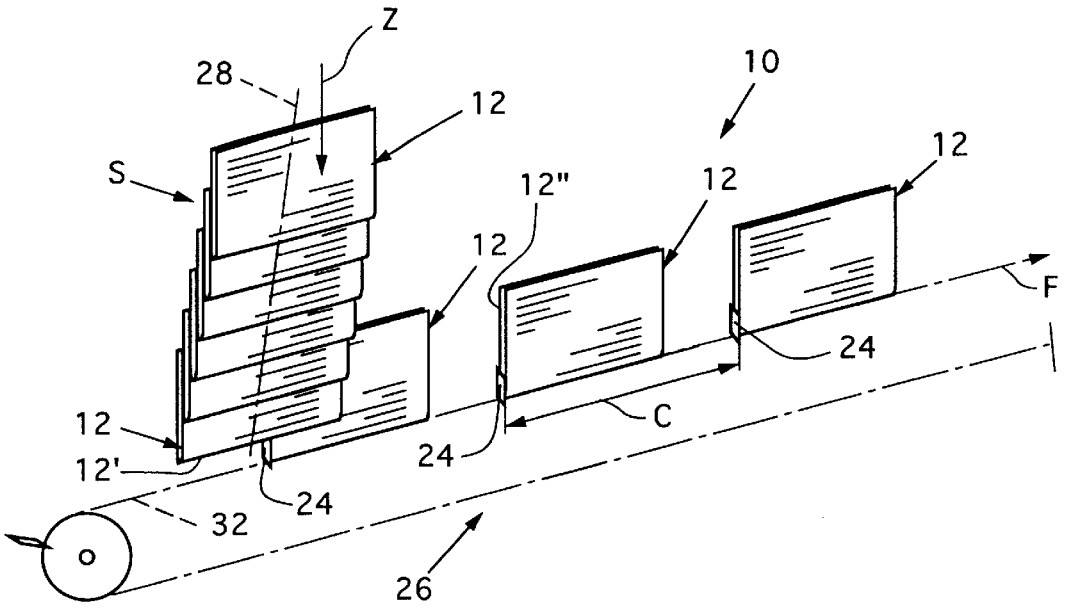
FIG. 4 shows a perspective, vastly simplified illustration of the apparatus of FIGS. 1 to 3 during the processing of printed products, the feeding direction running at right angles to the conveying direction.

In the embodiment shown in FIGS. 2 and 3, the pushing lugs 24 are arranged at a distance C one behind the other on a drawing member 32, for example a chain, which is driven continuously in circulation in the conveying direction F—see also FIG. 4 in this respect. However, as in the case of the apparatus according to FIG. 1, the pushing lugs 24 may also be arranged on transporting elements 34, which are assigned to a transporting channel 36, arranged beneath the processing channel 14, and are intended for transporting, in the longitudinal direction, printed products 12 which are introduced directly into the transporting channel 36 or are fed into the transporting channel 36 from the processing channel 14.

The feeding arrangement 28 transports the printed products 12 in an imbricated formation S, it being the case that, as seen in feeding direction Z, each printed product 12 rests on the preceding one, and a distance A between the leading edges 12', as seen in the feeding direction Z, of successive printed products 12 is greater than a distance D' from the base 16 to that part of the pushing lugs 24 which is furthest away from the said base and projects into the processing channel 14.

The feeding arrangement 28 has a conveying member 38, which is driven in the feeding direction Z, and a pressure-exerting element 42, which forms a conveying nip 40 with said conveying member. The conveying nip 40 terminates at a distance E from the base, this distance being greater than the dimension G of the printed products 12, measured at right angles to the leading edge 12' of the latter. The difference between E and G is advantageously kept as small as possible. It is, for example, smaller than 10 or 20% of the dimension G of the printed products 12.

As is indicated by the double arrow H in FIG. 2, the distance of the conveying nip 40 from the first side wall 18—measured at right angles to the latter—is greater than, for example, approximately double the thickness D of the printed products 12.

The conveying member 38 of the feeding arrangement 28 is formed by a continuous conveying belt 44, but preferably by two or more conveying belts which are spaced apart from one another transversely with respect to the feeding direction Z. Outside the processing channel 14, the conveying belt 44 is guided by a drive roller 46, which is connected to a drive, and, in the processing channel 14, the conveying belt 44 is guided about a deflecting roller 48, which is of considerably smaller diameter. The return strand 50 of the conveying belt 44 is deflected in the form of an S about a first roller 52 and then about a second roller 52', through 180E in each case. While the second roller 52' is mounted in a stationary manner, the first roller 52 is fastened, along with the deflection roller 48, on a common frame (not shown) whose position can be adjusted in, and counter to, the feeding direction Z in order for the distance E between the base 16 and the conveying nip 40 to be adapted to different dimensions G of the printed products 12 which are to be processed. This S-shaped deflection of the return strand 50 provides for automatic length compensation when the position of the deflecting roller 48 is changed.

The active run or strand 54 of the conveying belt 44, said active run or strand being parallel to the first side wall 18, bounds the conveying nip 40 together with the pressure-exerting element 42, which is designed as a roller path 56. That surface of the active strand 54 which is directed towards the roller path 56 is thus spaced apart from the first side wall 18 by the distance H. The roller path 56 comprises a multiplicity of rollers 60 which are arranged one behind the other, as seen in the feeding direction Z, and are mounted in a freely rotatable manner in a frame 58, it being the case that, as seen in the feeding direction Z, the frame 58 and thus the pressure-exerting element 42 are designed to be shorter than the active strand 54, and the roller which is arranged at the end 40' of the conveying nip 40 is located opposite the deflecting roller 48. The active strand 54 thus projects beyond the pressure-exerting element 42 on the side which is directed away from the processing channel 14 and forms a feed surface 62 for the printed products 12 which are to be fed to the conveying nip 40. For the sake of completeness it should be mentioned that, as seen in the feeding direction Z, the frame 58 with the rollers 60 is arranged in a fixed manner with respect to the deflecting roller 48 and, in contrast, in a movable manner in terms of the distance from the active strand 54. Forced against the active strand 54 by virtue of its own dead weight and/or by virtue of an external force, the pressure-exerting element 42 is automatically adjusted in position to the thickness D of the printed products 12 and the thickness of the imbricated formation S. The force which is exerted on the printed products 12 by the pressure-exerting element 42 is of such a magnitude that said printed products are carried along in a frictionally locking manner with the conveying member 38.

Apparatuses with a transporting channel 36 and a processing channel 14 arranged therein are disclosed, for example, in CH Patent Applications Nos. 1997 0325/97 and 1997 0366/97 and the corresponding international Patent Applications PCT/CH98/00015 and PCT/CH98/00016. The transporting channel 36 is bounded by wall elements 64 which are arranged at an angle with respect to one another. The distance between these wall elements in the base region of the transporting channel 36 is spanned by base elements 66. The base elements 66, which are arranged one behind the other, are mounted in a continuous guide and driven in circulation in the conveying direction F by means of a drive device. Transporting elements 34, which also each bear a pushing lug 24, are fastened on certain base elements 66. The driving of the base elements 66 means that printed products 12 which are located both in the transporting channel 36 and in the processing channel 14 are transported in the conveying direction F, in that the transporting elements 34 and/or pushing lugs 24 act with pushing action on the trailing edge 12", as seen in the conveying direction F, of the printed products 12. This relates to the embodiment of the apparatus according to FIG. 1; in principle, however, it is not necessary for the apparatus to have a transporting channel 36, as can be seen, for example, from FIGS. 2 and 3.

According to FIG. 1, the printed products 12 are fed to the feeding arrangement 28 by means of a transporting arrangement 68. The latter has individual transporting clamps 72 guided in rails 70. A transporting arrangement 68 of this type is disclosed, for example, in CH Patent Application No. 1996 1818/96 and in the corresponding international Patent Application PCT/CH97/00192. In a sloping section 70' of the rail 70, the clamps move towards a controlled blocking element 74 and are restrained by the latter. Arranged downstream of the blocking element 74 is a controlled opening element 76 which is intended for opening the transporting clamp 72, which is released in each case by the blocking element 74 synchronously with the conveying arrangement 26, in order to relieve the printed product 12 which has been transported in the hanging position by the transporting clamp 72. Arranged downstream of the blocking element 74 are drive means 78 for the purpose of transporting further, in the direction of circulation U in each case, the transporting clamps 72 which have been released by the blocking element 74. The imbricated formation S in which the printed products 12 are introduced into the processing channel 14 is thus determined by the speed of the conveying member 38 and the opening of the transporting clamps 72.

As can be seen from FIG. 1, the active strand 54 forms a feed surface 62 for the printed products 12 which are fed from the transporting arrangement 68 and released in time with the conveying arrangement 26 in each case.

At the point in time which is shown in FIG. 2, the feeding arrangement 28 has just released a printed product 12, which then has its leading edge 12' butting against the base 16 and a flat side butting against the first side wall 18. The pushing lug 24 has come into abutment against the trailing side edge 12", as seen in the conveying direction F, of said printed product 12, in order to push it forwards in the longitudinal direction of the processing channel 14. A printed product 12 which follows this first-mentioned printed product 12 is retained in the conveying nip 40 and overlaps said first-mentioned printed product by way of its part which projects from the conveying nip 40, it being the case that, as seen in the feeding direction Z, the edge 12' has not yet reached the pushing lug 24.

At the point in time which is shown in FIG. 3, the pushing lug 24 has advanced in the conveying direction F the printed product 12 which is butting against the base 16 and the side wall 18, it being the case that, as seen in the conveying direction F, the pushing lug 24 is still located in the region of the printed product 12 which is retained in the conveying nip 40. As it is pushed into the processing channel 14, said printed product has come into abutment against the deflecting surface 30 by way of its leading edge 12', as a result of which it has been deflected away from the first side wall 18 in the direction of the second side wall 20 and then passes through the free space B between the pushing lug 24 and the second side wall 20. Since the printed product is still retained in the conveying nip 40 it cannot be carried along by the pushing lug 24 or the printed product 12 which is moved by the latter. The deflecting surface 30 thus forms a means 30' for directing those printed products 12 which are retained in the conveying nip 40 out of the region of movement of the pushing lugs 24 and thus for preventing these printed products 12 from being carried along by the pushing lugs 24.

All that is shown in FIG. 4 of the apparatus 10 is the conveying arrangement 26 with the pushing lugs 24 which are arranged at a distance C one behind the other on a drawing member 32 which is driven continuously in circulation in the conveying direction F. The feeding arrangement is indicated by a chain-dotted line designated by 28. The feeding direction Z runs at right angles to the conveying direction F, and thus at right angles to the longitudinal direction of the processing channel. The point in time during the processing of the printed products 12, which are fed in an imbricated formation S by means of the feeding arrangement 28, which is illustrated in FIG. 4 corresponds to the point in time which is shown in FIG. 3. The front printed product 12, as seen in the feeding direction Z, of the imbricated formation S has been deflected out of the region of action of the pushing lug 24 by the deflection surface 30 thereof. The pushing lug 24 and the other two pushing lugs 24 shown each butt against the trailing side edge 12" of a previously fed printed product 12 and push the latter further in the conveying direction F. The imbricated formation S and the feeding speed as well as the speed of, and the distance between, the pushing lugs are coordinated with one another such that one printed product 12 coincides with each pushing lug 24. Since the distance C between successive pushing lugs 24 is greater than the length of the edge 12' of the printed products 12, the printed products which are introduced into the processing channel in the imbricated formation S are deflected in the conveying direction F and separated at the same time. It can easily be appreciated that, even with the high processing capacity of the apparatus 10, the conveying speed of the feeding arrangement 28 can be kept low.

Figure 5:
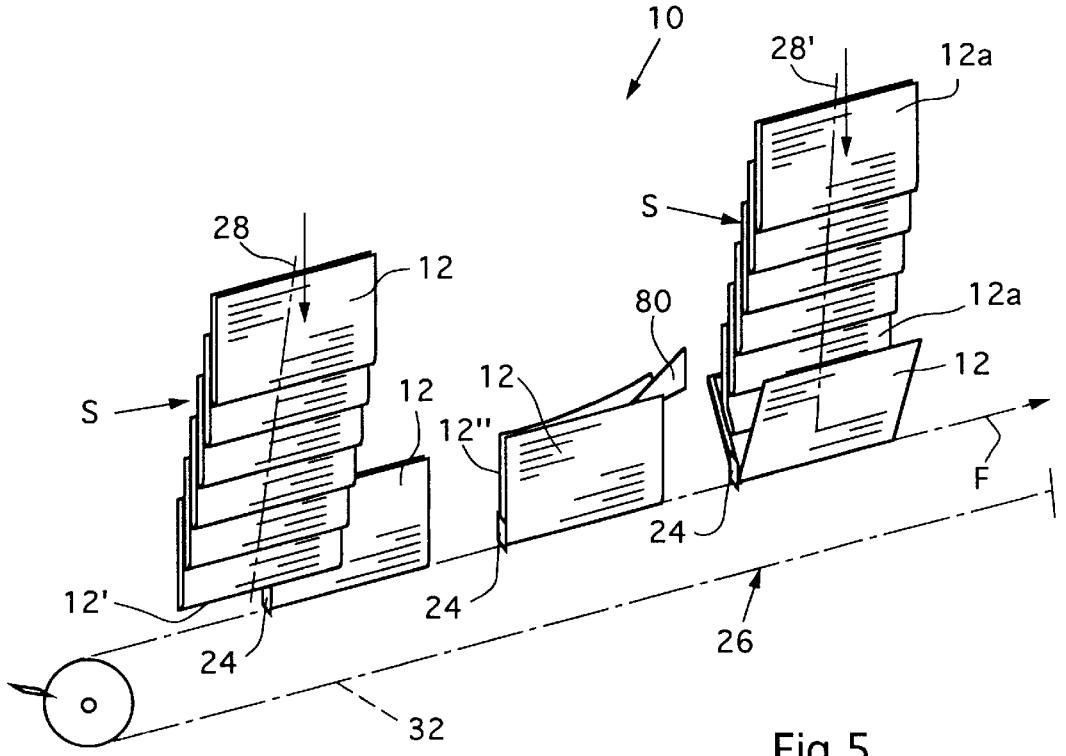
FIG. 5 shows, in the same illustration as FIG. 4, the apparatus which is shown in FIG. 4 but with a further feeding arrangement and a means for opening printed products.

FIG. 5 illustrates the apparatus 10 in the same way as in FIG. 4. The processing channel is assigned an opening device 80, which is intended for opening printed products 12 which are transported past it by means of the conveying arrangement 26. As seen in the conveying direction F, said opening device is arranged downstream of the feeding arrangement 28 and upstream of a further feeding arrangement 28'. The latter is intended for introducing in each case one further printed product 12*a* into the printed products 12 which have been opened by means of the opening device 80. The printed products 12, 12*a*, which are fed in an imbricated formation, are carried along and separated at the same time by means of the conveying arrangement 26 in the same way as has been described in connection with FIGS. 1 to 4.

Figure 6:
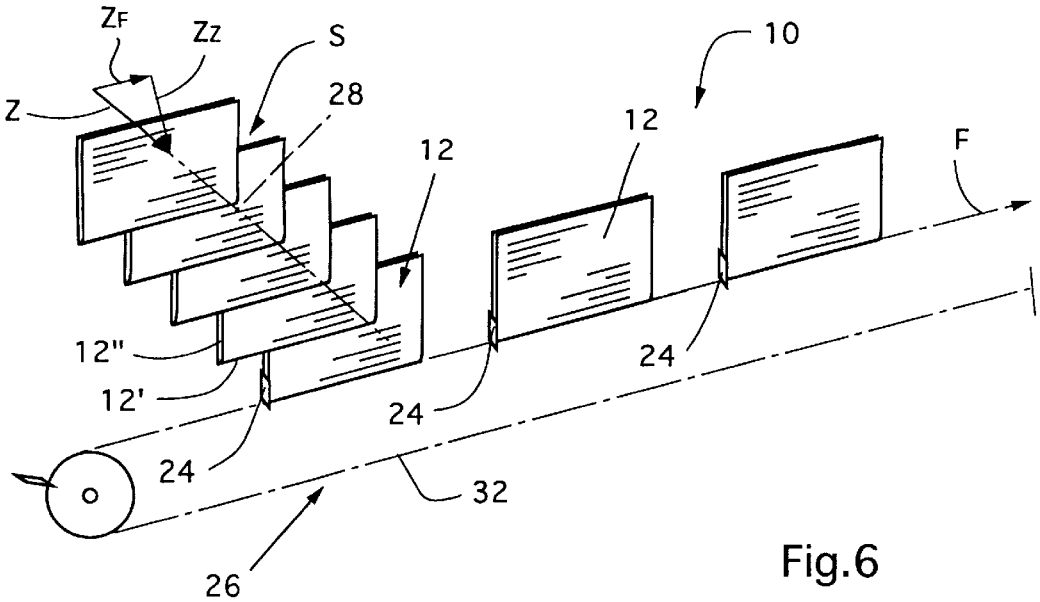
FIG. 6 shows, in the same illustration as FIG. 4, an embodiment of the apparatus in which the feeding direction runs at an inclined angle with respect to the conveying direction.

FIG. 6 shows the apparatus 10 according to the invention in the same way as FIG. 4. In this case, however, the feeding direction Z of the feeding arrangement 28 has, in addition to a component $Z_Z$ which runs at right angles to the conveying direction F, a component $Z_F$ which runs in the conveying direction F. The feeding arrangement 28 introduces the printed products 12 into the processing channel, once again, in an imbricated formation S, it also being the case here that the edges 12' run parallel to the base 16; see FIGS. 1 to 5. In this imbricated formation, it is not just the edges 12', but also the side edges 12", which are spaced apart from one another. In this case too, in each case one pushing lug 24 runs up against the printed product 12 just released from the conveying nip 40, butts against the side edge 12" and carries along the printed product 12 in the conveying direction F. It can be appreciated that, at the same speeds as in the embodiment according to FIGS. 4 and 5, in the embodiment according to FIG. 6 the acceleration forces acting on the printed products 12 are smaller when the pushing lugs 24 run up against the printed products 12, because the latter are already being conveyed with a component in the conveying direction F even as they are being introduced into the processing channel.

Figure 7:
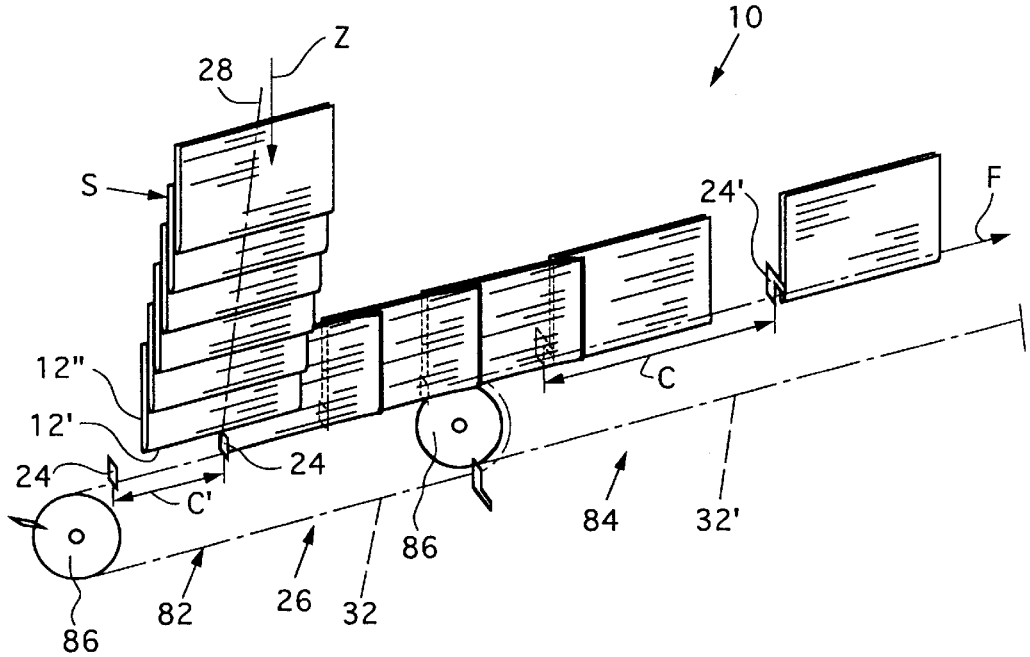
FIG. 7 shows, in the same illustration as in FIG. 4, an embodiment of the apparatus with two conveying arrangements which are arranged one behind the other in the conveying direction and are intended for separating the printed products in the processing channel.

In the embodiment shown in FIG. 7, the conveying arrangement 26 has two conveyor segments 82, 84, which are arranged one behind the other in the conveying direction F. The first conveyor segment 82, once again, has an endless drawing member 32 on which pushing lugs 24 are arranged at a distance C' one behind the other, in this case the distance C' being smaller than the length of the edges 12' of the printed products 12 which are to be processed. The drawing member 32 is guided about two deflecting wheels 86, a further deflecting wheel (not shown) being mounted equiaxially with the downstream deflecting wheel 86. Guided about said deflecting wheel which is not shown is a drawing member 32' of the second conveyor segment 84, on which further pushing lugs 24' are arranged at a distance C one behind the other, this distance being greater than the length of the edges 12' of the printed products 12. The speeds of the drawing members 32, 32' are coordinated with one another such that a pushing lug 24' coincides with a pushing lug 24 in the region of the deflecting wheel 86 in each case.

The printed products, which are fed in the imbricated formation S, then, are deflected, but not separated, by being carried along by the pushing lugs 24 in the conveying direction F. This forms a new imbricated formation, in which the printed products overlap as seen in the conveying direction F. The printed products 12 are then separated in the region of the second conveyor segment 84 as a result of the higher speed at which the pushing lugs 24' circulate.

Of course, it is also conceivable, analogous to FIG. 7, for the printed products which are fed to be left in the imbricated formation, and not separated, in the processing channel 14.

Both the conveying member 38 and the pressure-exerting element 42 may be of different designs. Thus, for example, it is possible for the conveying member 38 to have driven rollers arranged one behind the other. Similarly, it is possible for the pressure-exerting element 42 to have an endless belt or a pressure-exerting rail.

Of course, it is also possible for the printed products to be fed to the feeding arrangement 28 in a state in which they are already imbricated, for example from a storage roll.

The conveying elements 24" may also be formed by conveying clamps, which, for the purpose of transportation in the conveying direction F, clamp the printed products 12 which have been introduced into the processing channel. An example of such a conveying clamp 24"' is indicated by dashed lines in FIG. 6. It has a deflecting surface 30 which prevents printed products 12 which are retained in the conveying nip 40 from being carried along.

It is also conceivable for the base to be designed so as to circulate in the conveying direction and for the conveying elements to be arranged thereon.

That which is claimed:

1. An apparatus for processing printed products comprising a stationary processing channel which includes at least one side wall and a base, and which defines a longitudinal direction, a feeding arrangement for introducing printed products into the processing channel in an imbricated formation and so that the introduced printed products each define a leading edge which is brought into contact with the base of the processing channel and a flat side which engages against the one side wall of the processing channel, a conveying arrangement for serially transporting the printed products which are introduced into the processing channel by the feeding arrangement longitudinally along the processing channel, said conveying arrangement including a conveyor mounting a plurality of longitudinally spaced apart conveying elements which project into the processing channel, and drive means for advancing the conveyor so as to advance the conveying elements longitudinally along the processing channel, and means for laterally deflecting the leading edges of the printed products out of the region of movement of the conveying elements as the printed products are advanced into the processing channel by said feeding arrangement.

2. The apparatus as defined in claim 1 wherein the feeding arrangement comprises a conveying member which is driven in a feeding direction and a pressure exerting member which forms a conveying nip with the conveying member, and wherein the conveying nip terminates at a distance spaced above the base of the processing channel.

3. The apparatus as defined in claim 2 wherein the distance the conveying nip terminates above the base of the processing channel is somewhat greater than the dimension of the printed products measured perpendicularly to the leading edges thereof.

4. The apparatus as defined in claim 3 wherein the laterally deflecting means comprises a deflecting surface on an upper side of each of the conveying elements, with the deflecting surfaces being positioned to engage the leading edges of the printed products as they are advanced into the processing channel by said feeding arrangement.

5. The apparatus as defined in claim 3 wherein the processing channel further includes a second side wall, with the second side wall being laterally spaced from the one side wall and the conveying elements as they advance longitudinally along the processing channel and so as to define a free space for accommodating the printed products as they are advanced into the processing channel by said feeding arrangement and deflected by said deflecting means.

6. The apparatus as defined in claim 3 wherein the feeding arrangement is mounted so as to permit the adjustment of said distance of the conveying nip above the base of the processing channel.

7. The apparatus as defined in claim 3 wherein the feeding arrangement is configured so that the direction in which the printed products are introduced into the processing channel is substantially perpendicular to the longitudinal direction.

8. The apparatus as defined in claim 3 wherein the feeding arrangement is configured so that the direction in which the printed products are introduced into the processing channel has a component which is perpendicular to the longitudinal direction and a component which is parallel to the longitudinal direction and along the direction of the advance of the conveying elements.

9. The apparatus as defined in claim 3 wherein the conveying nip defines a discharge end which is laterally spaced from said one side wall of the processing channel a distance at least equal to the thickness of the printed products.

10. The apparatus as defined in claim 3 wherein the conveying member of the feeding arrangement comprises an endless conveying belt which is entrained about a first roller located outside of the processing channel and about a second roller located within the processing channel, with the first and second rollers being positioned so as to define an active run of the conveying belt which is substantially parallel to said one side wall.

11. The apparatus as defined in claim 10 wherein the pressure exerting member of the feeding arrangement is shorter than the active run of the conveying belt.

12. The apparatus as defined in claim 3 wherein the feeding arrangement further comprises a transporting arrangement for serially discharging the printed products onto the conveying member in a manner synchronized with the longitudinal movement of the conveying elements of the conveying arrangement.

13. The apparatus as defined in claim 3 wherein said conveyor of said conveying arrangement comprises an initial conveyor segment and a following conveyor segment, with the initial and following conveyor segments each having said conveying elements mounted thereon, and with the conveying elements of said initial conveyor segment being more closely spaced apart than the conveying elements of said following conveyor segment.

14. The apparatus as defined in claim 13 wherein said drive means for advancing the conveyor includes provision for advancing the following conveyor segment at a speed greater than the speed of the initial conveyor segment.

* * * * *